US007743947B2

(12) United States Patent
Flasch

(10) Patent No.: US 7,743,947 B2
(45) Date of Patent: Jun. 29, 2010

(54) CLEANING TOOL

(75) Inventor: Stephen John Flasch, Forest Lake, MN (US)

(73) Assignee: Green Bay Consulting, Inc., Green Bay, WI (US)

( * ) Notice: Subject to any disclaimer, the term of this patent is extended or adjusted under 35 U.S.C. 154(b) by 152 days.

(21) Appl. No.: 11/825,134

(22) Filed: Jul. 3, 2007

(65) Prior Publication Data

US 2008/0011331 A1 Jan. 17, 2008

Related U.S. Application Data

(60) Provisional application No. 60/811,130, filed on Jul. 5, 2006.

(51) Int. Cl.
*B05B 11/00* (2006.01)
*B08B 13/00* (2006.01)

(52) U.S. Cl. ..... 222/192; 222/383.1

(58) Field of Classification Search ..... 312/34.8; 222/195, 192, 383.1; 134/42, 198
See application file for complete search history.

(56) References Cited

U.S. PATENT DOCUMENTS 1,255,772 A * 2/1918 Miller ..... 206/226
1,523,297 A * 1/1925 Savery ..... 206/226
1,582,645 A * 4/1926 Findley ..... 206/226
1,588,577 A * 6/1926 Heifler ..... 242/588
4,436,224 A * 3/1984 McInerny ..... 222/192
4,516,676 A * 5/1985 Cournoyer ..... 206/226
D307,843 S 5/1990 Parshall
5,035,321 A * 7/1991 Denton ..... 206/225
D363,214 S 10/1995 Parola et al.
5,763,984 A * 6/1998 Day ..... 312/34.8
5,819,989 A * 10/1998 Saraceni ..... 222/192
D406,976 S 3/1999 Baggett
6,138,874 A * 10/2000 Audrey ..... 222/192
6,216,920 B1 4/2001 Baggett
6,405,972 B1 * 6/2002 Wakam ..... 242/597.7
6,431,405 B2 * 8/2002 Irwin ..... 222/192
6,644,563 B2 * 11/2003 Presson ..... 239/289
6,883,989 B2 * 4/2005 Kushner et al. ..... 401/125
7,354,598 B2 * 4/2008 Masting ..... 424/443
2004/0251265 A1 * 12/2004 FitzSimons et al. ..... 221/92

* cited by examiner

*Primary Examiner*—Kenneth Bomberg
(74) *Attorney, Agent, or Firm*—Merchant & Gould P.C.

(57) ABSTRACT

The present disclosure provides an integrated spray and wipe system. A method of using such a system is also provided. In one embodiment, the system includes a fluid reservoir that extends through the center of a roll of cleaning material (e.g., paper towel roll). The tool houses cleaning fluid and cleaning wipes and therefore can be used to dispense liquid or cleaning wipes as needed.

16 Claims, 8 Drawing Sheets

CLEANING TOOL

CROSS REFERENCE TO RELATED APPLICATIONS

This application claims the priority to U.S. Provisional Application Ser. No. 60/811,130 titled SPRAY N' DRY PAPER TOWEL, TRIGGER SPRAYER, DISPENSER STAND AND/OR HOLDER filed on Jul. 5, 2006, which is herein incorporated by reference in its entirety.

TECHNICAL FIELD

A tool for spraying cleaning fluid and dispensing cleaning wipes and a method of using the same.

BACKGROUND

Spray bottles for spraying cleaning fluids are known. Cleaning wipe dispensers are also known. Typically, spray bottles and cleaning wipe dispensers are separate stand alone devices. Non-integrated spray and wipe devices can be difficult to transport and use in the field. An integrated spray and wipe system that would be easier to use and transport is desirable.

SUMMARY

An embodiment of the present disclosure provides an integrated spray and wipe system. A method of using such a system is also provided. In one embodiment, the system includes a fluid reservoir that extends through the center of a roll of cleaning material (e.g., paper towel roll). The tool houses cleaning fluid and cleaning wipes and therefore can be used to dispense liquid or cleaning wipes as needed.

DETAILED DESCRIPTION OF THE PREFERRED EMBODIMENT

Figure 1:
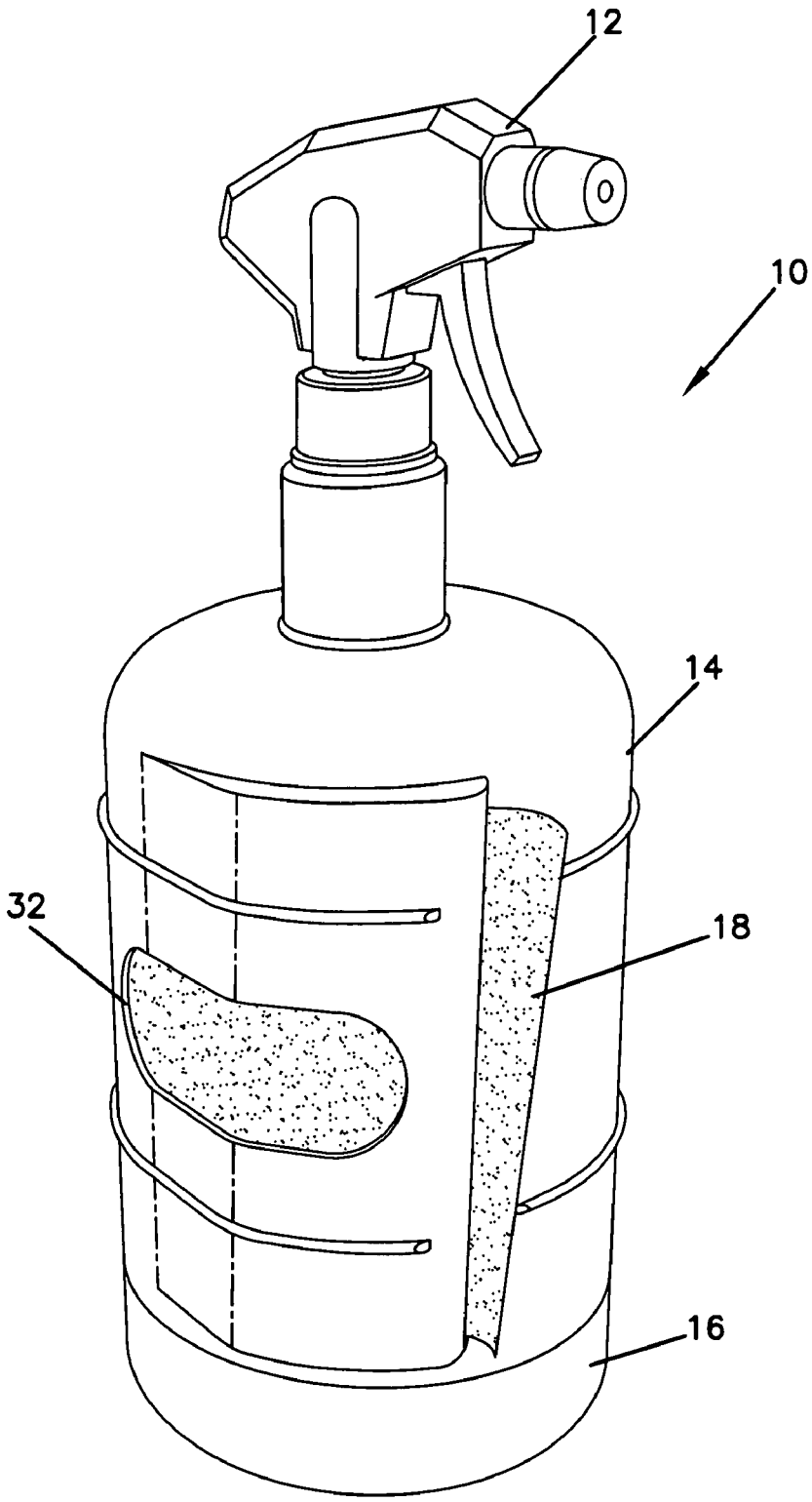
FIG. 1 is a perspective view of an embodiment of the cleaning tool in accordance with the present disclosure.

Referring to FIG. 1, a perspective view of an embodiment of a cleaning device according to the present disclosure is shown. The cleaning device 10 includes a spray head 12 for distributing cleaning fluid, a housing 14 for housing a cleaning material 18 (e.g., a roll or cube of paper towels, glass wipes, cleaning cloths, etc.), and a reservoir 16 for containing fluid (e.g., cleaning chemicals). FIG. 1 depicts the cleaning device 10 with the housing 14 loaded with a cleaning material 18. The cleaning material in the depicted embodiment is a roll of paper towels. However, it should be appreciated that many alternative forms and types of cleaning material are also possible.

Figure 2:
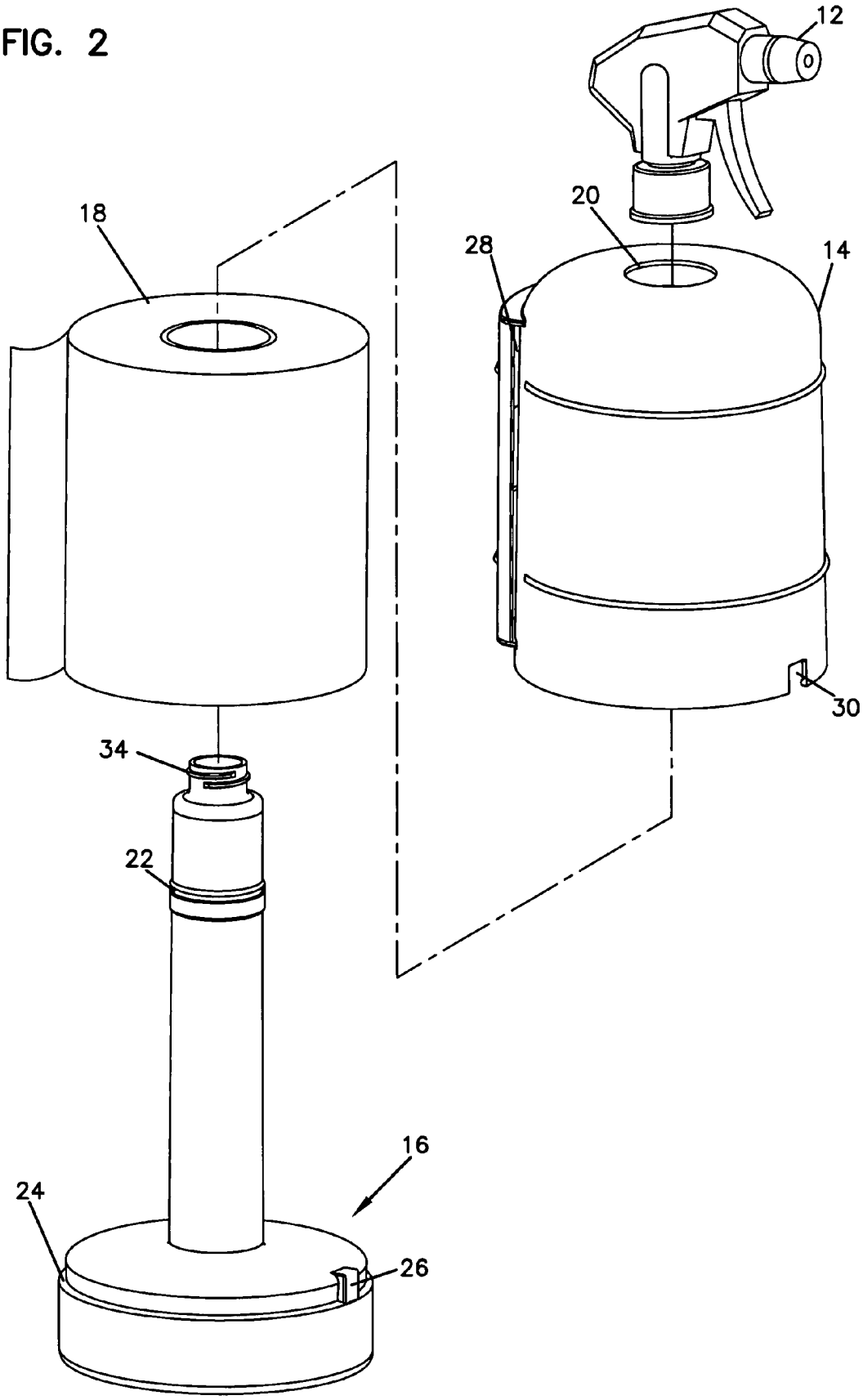
FIG. 2 is a perspective assembly view of the cleaning tool of FIG. 1.
Figure 3:
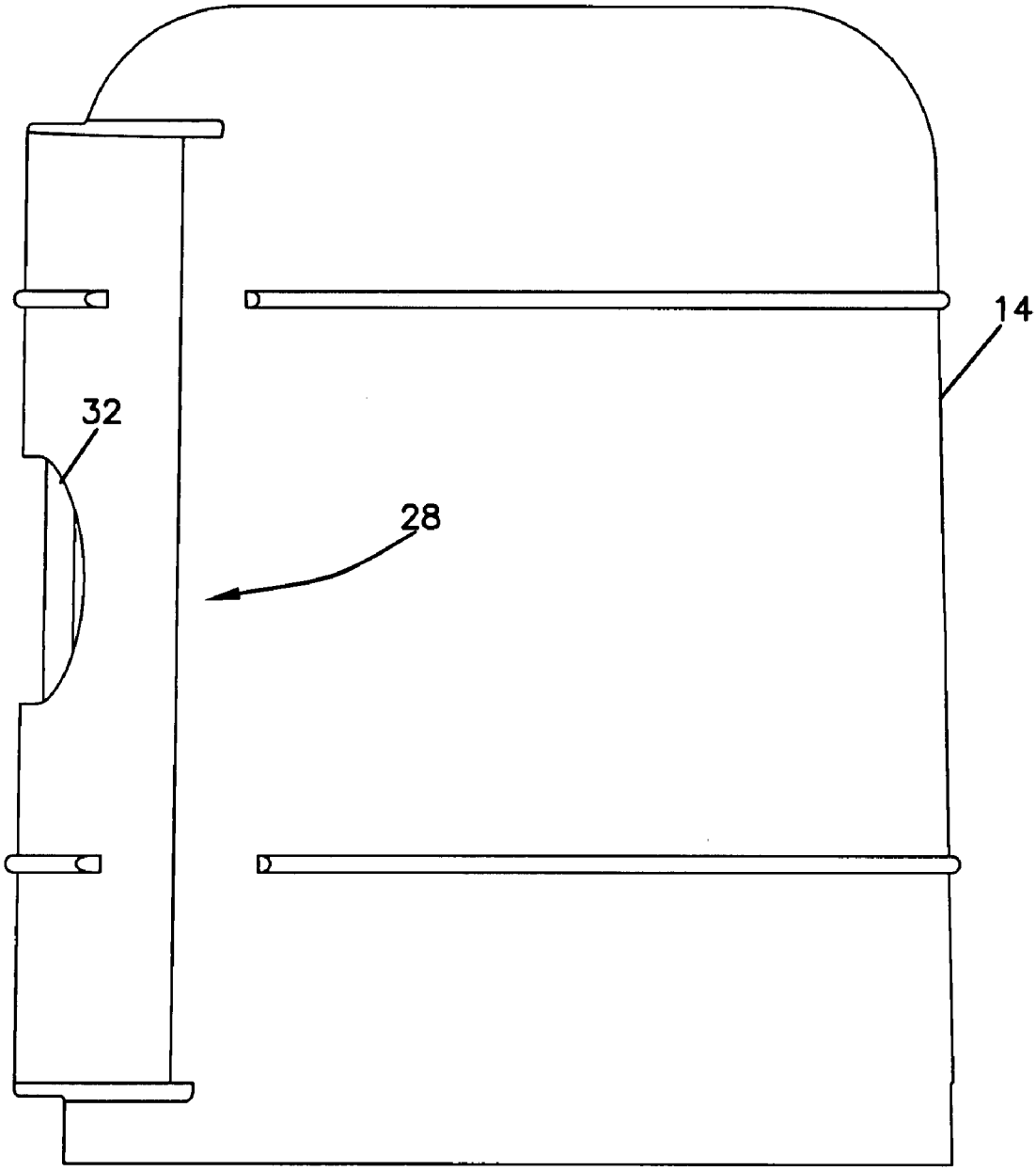
FIG. 3 is a first side view of the housing of the cleaning tool of FIG. 1.
Figure 4:
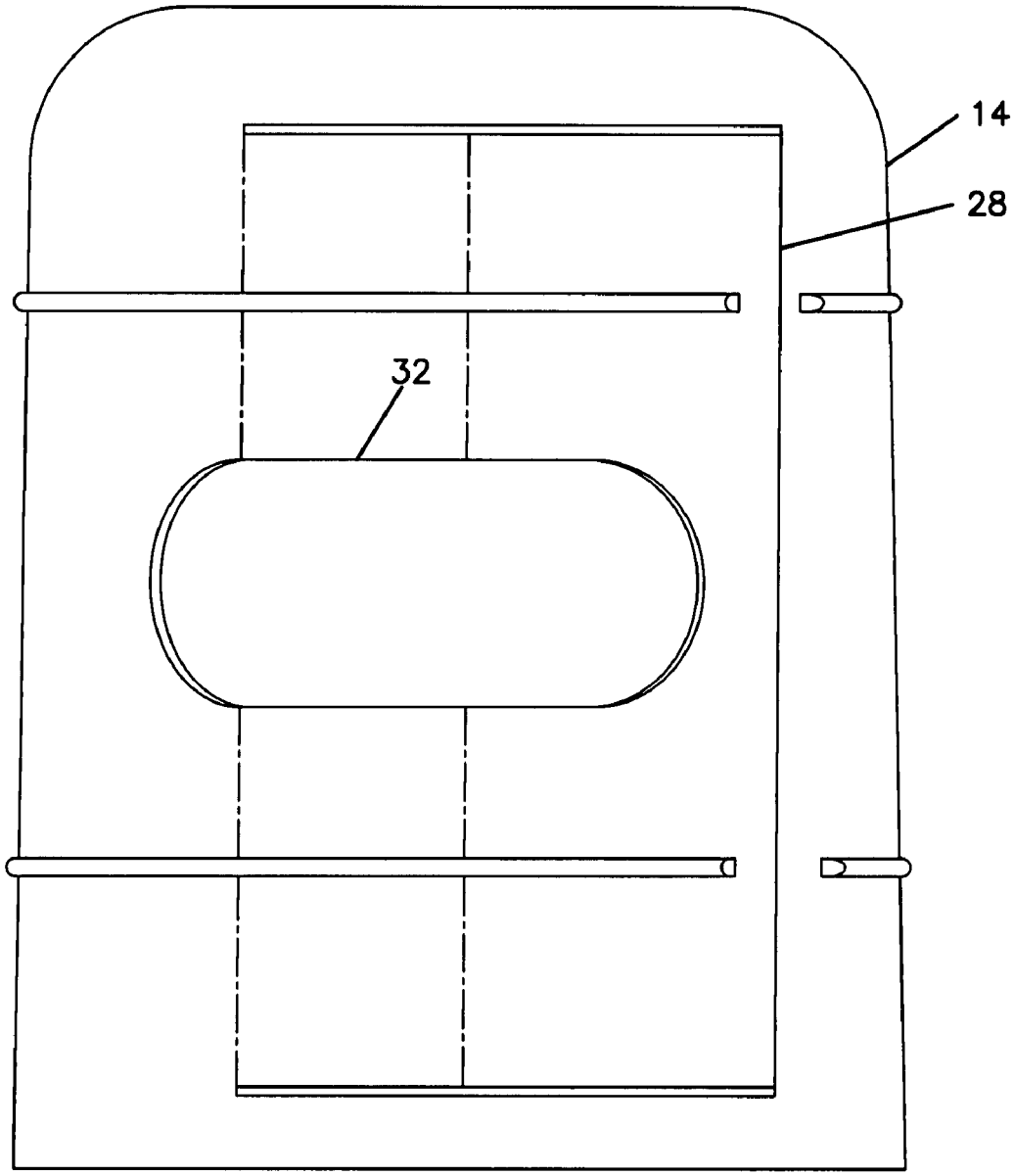
FIG. 4 is a second side view of the housing of the cleaning tool of FIG. 1.
Figure 5:
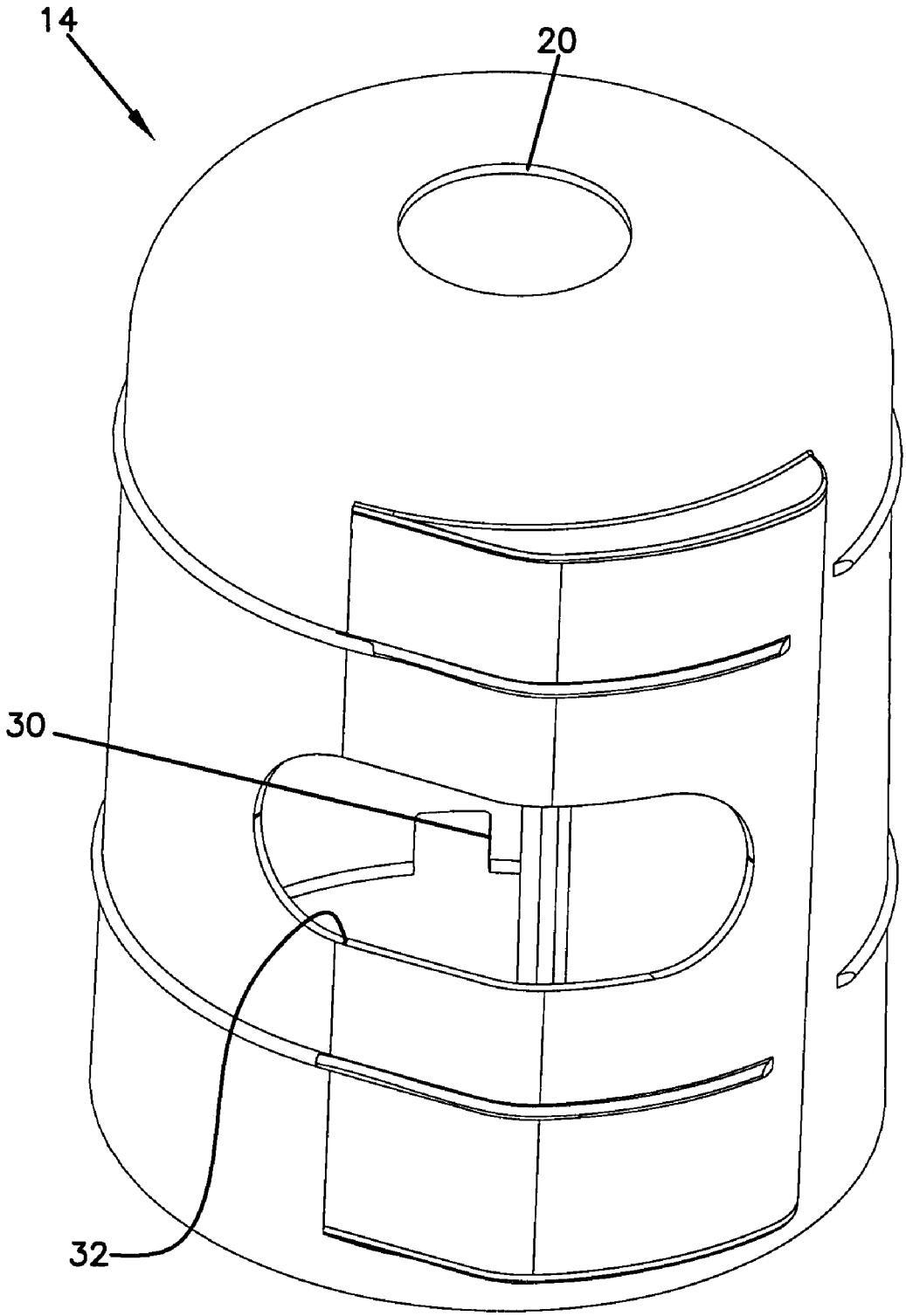
FIG. 5 is a top perspective view of the housing of the cleaning tool of FIG. 1.
Figure 6:
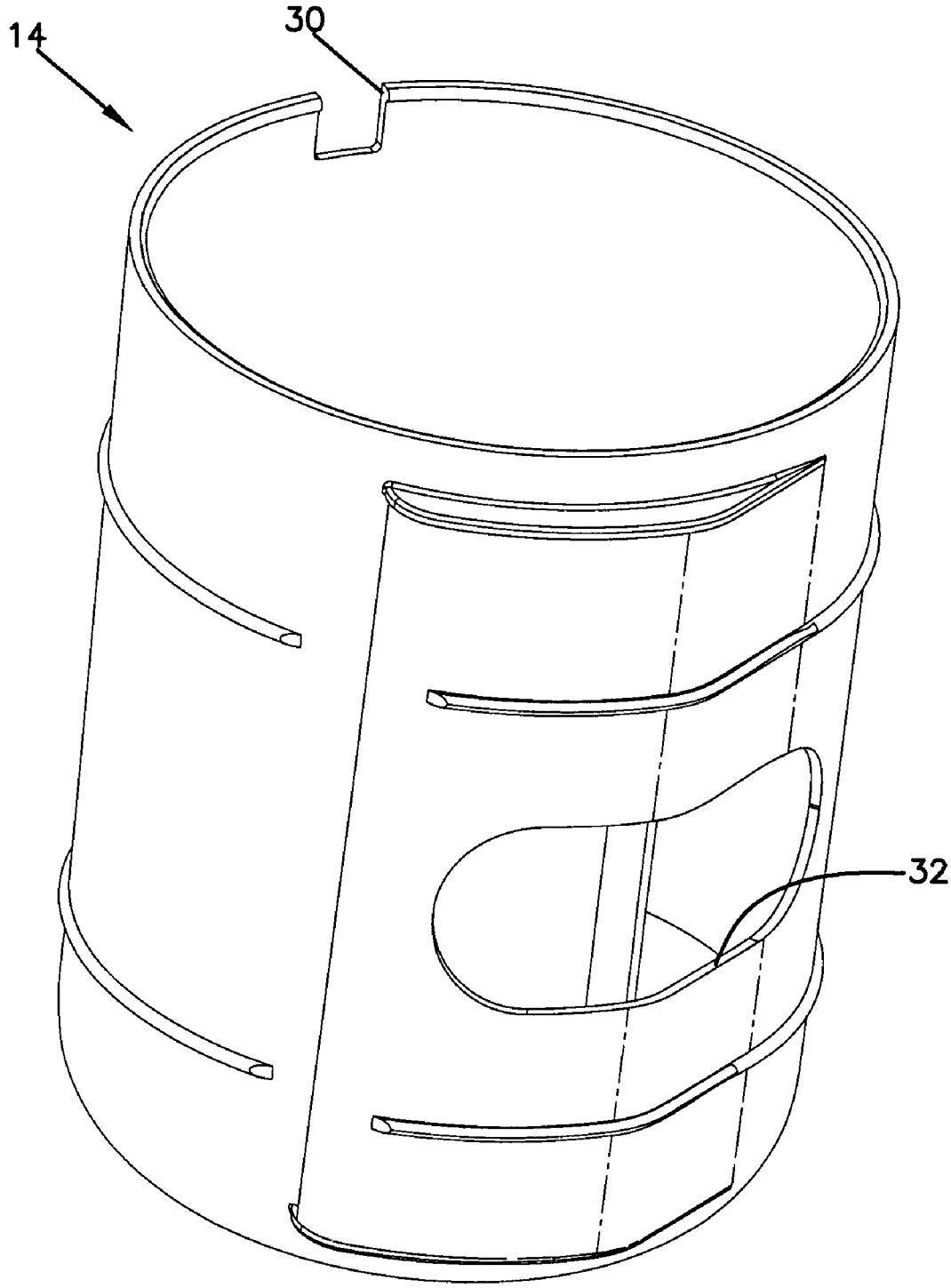
FIG. 6 is a bottom perspective view of the housing of the cleaning tool of FIG. 1.

Referring to FIG. 2, the cleaning device 10 is shown in an exploded assembly view. To load the cleaning device 10 with cleaning materials 18 the spray head 12 and the reservoir 16 are disconnected. In the depicted embodiment the spray head 12 and the reservoir 16 are connected via threads. Disconnecting the spray head 12 from the reservoir 16 involves rotating the spray head 12 and reservoir 16 relative to each other. In the depicted embodiment the housing 14 is positioned between the spray head 12 and the reservoir 16. The lower end of the housing 14 is shown contacting the base of the reservoir 16 and the upper end of the housing 14 is shown contacting the neck of the reservoir 16.

More particularly, in the depicted embodiment the neck of the reservoir 16 extends through an aperture 20 at the top end of the housing 14. The neck of the reservoir 16 includes a channel 22 that supports the top end of the housing 14. The channel 22 is one of many means to secure the housing 14. For example, in an alternative embodiment the device 10 can be configured such that the housing 14 is secured by connecting the spray head 12 to reservoir 16.

In the depicted embodiment, the lower end of the housing 14 is seated in a radial shelf 24 disposed along the base of the reservoir 16. The shelf includes a tab 26 that orients the housing 14 relative to the reservoir 16. In the depicted embodiment the housing 14 and the lower end of the reservoir 16 are generally cylindrically shaped. Moreover, the outer diameter of the lower end of the housing 14 is generally the same as the diameter of the base of the reservoir 16. It should be appreciated that in alternative embodiments the housing and the base can be of different shapes, and the housing and the base can connect in different ways. For example, the housing could thread to the base, fit within grooves on the base, or snap over the base.

Referring to FIGS. 3-6 an embodiment of the housing 14 is shown. In the depicted embodiment the upper end of the housing 14 is a single integrated component of the device 10. It should be appreciated that in alternative embodiments the housing 14 could be integrally formed with the reservoir 16, or the housing 14 could comprise a number of separate parts that can be connected together. For example, in alternative embodiments the upper end of the housing could be a separate cap that connects to the body of the housing 14. In the depicted embodiment the upper portion of the housing 14 includes a generally domed-shaped portion having an aperture 20 therein for receiving the neck of the reservoir 16. The body of the housing 14 includes a side opening 28 for dispensing cleaning materials (e.g., paper towels on a roll). The lower end of the housing 14 is open and includes a notch 30 that locates the housing on the base of the reservoir 16.

In the depicted embodiment the side opening 28 includes a portion of the side walls of the housing that overlap. The overlapping portion includes an aperture 32 that makes it easier to access the cleaning material within the housing 14. The aperture 32 is configured such that a user can reach into the housing with his or her fingers and pull a portion of the cleaning material into the side opening 28. The side opening 28 of the depicted embodiment is configured to enable the user to tear off portions of the cleaning material if the cleaning material is in the form of a continuous sheet of material. For example if the cleaning material is on a roll that unwinds by pulling the sheet in a counterclockwise direction, the user can pull the material swiftly against the overlapping portion in a clockwise direction to tear off a portion of the cleaning material. In some embodiments the overlapping portion can include serrations to facilitate the tearing.

Figure 7:
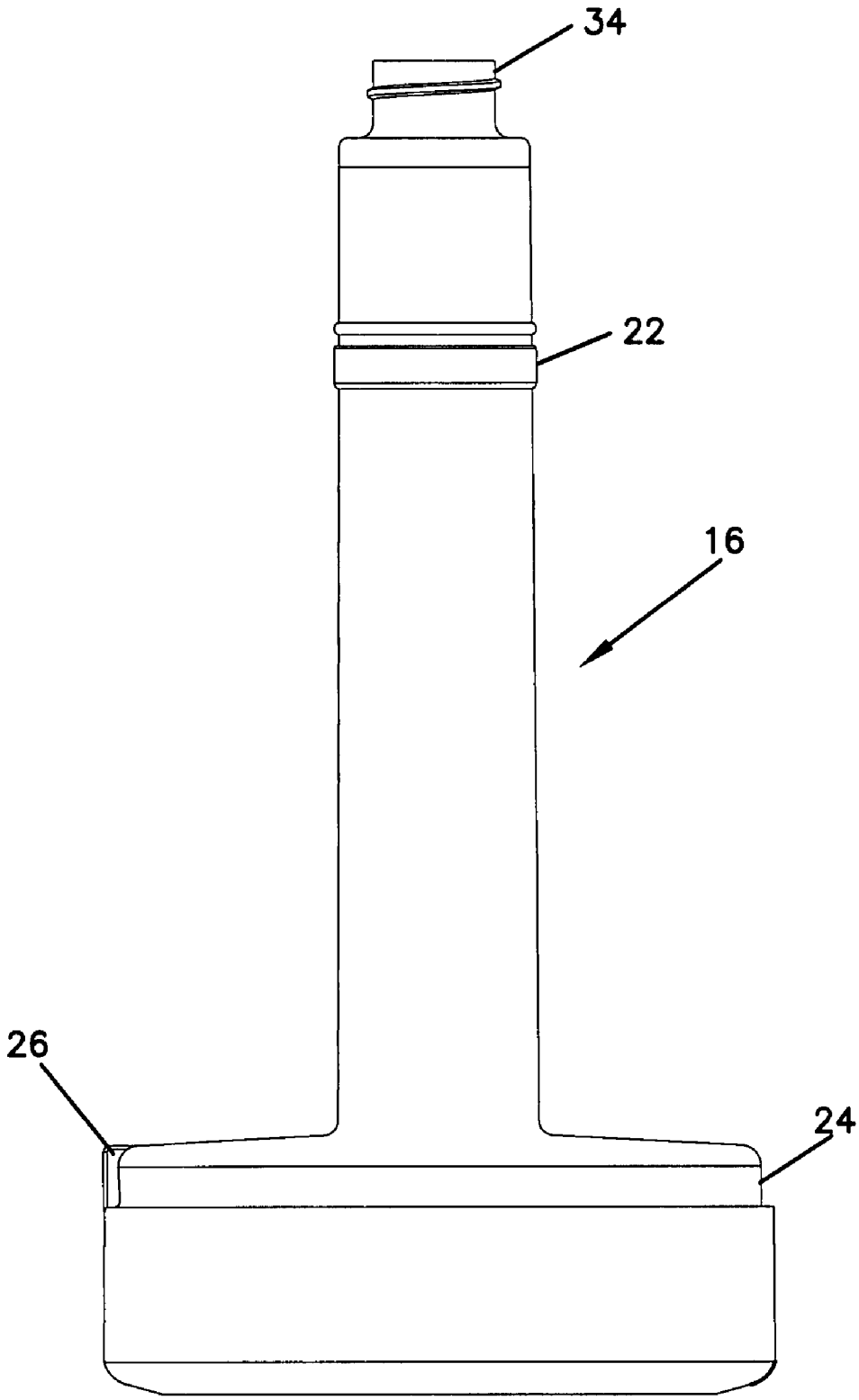
FIG. 7 is a first side view of the reservoir of the cleaning tool of FIG. 1.
Figure 8:
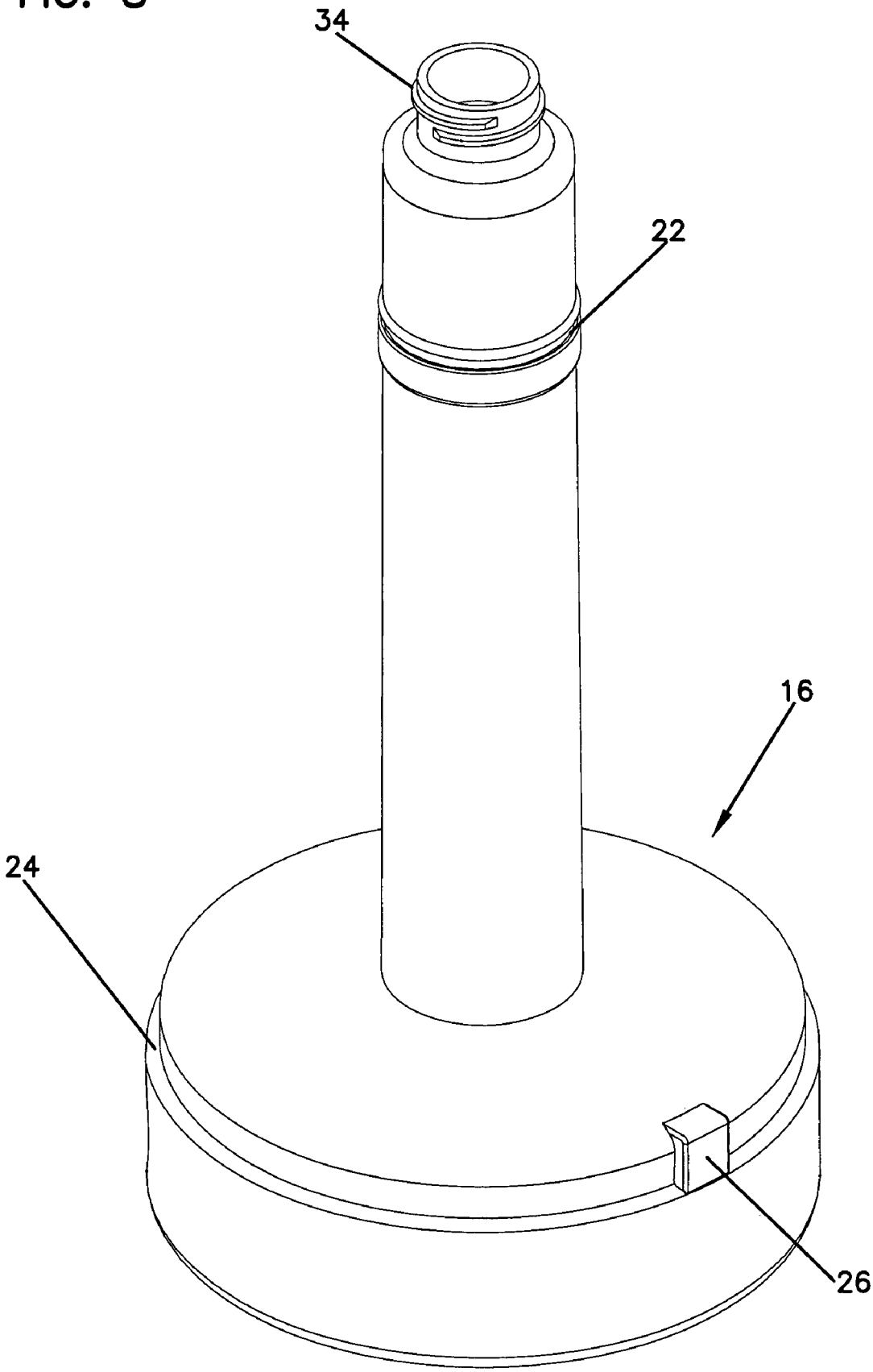
FIG. 8 is a top perspective view of the reservoir of the cleaning tool of FIG. 1.

Referring to FIGS. 7-8, an embodiment of the reservoir 16 is shown. The reservoir 16 of the depicted embodiment includes a cylindrical base connected to a cylindrical neck. The upper end of the base includes an annular step that is configured to engage the bottom end of the housing 14. The upper end of the neck includes threads 34 that are configured to engage the spray head. A portion of the neck also include a channel 22 configured to engage the upper end of the housing 14. In the depicted embodiment the diameter of the largest portion of the neck is less than about 3 inches and the length of the neck is between 4-24 inches. The configuration enables the neck to slide into the center of rolls of cleaning materials. In the depicted embodiment the base of the reservoir has a diameter of between about 3 to about 12 inches. It should be appreciated that many alternative configurations and sizes of the reservoir 16 are possible.

In one embodiment, the cleaning device 10 can be loaded by pouring cleaning fluid into the neck of a reservoir 16, positioning cleaning material 18 (e.g., roll of cleaning drying wipes) around the neck of the reservoir 16, positioning a housing 14 around the roll of cleaning material 18, connecting a spray head to the neck of the reservoir (e.g., threading the spray head to the reservoir), and pulling a portion of the cleaning material 18 through an opening 28 in the housing 14. Once the device is loaded, cleaning liquid can be dispensed when the user squeezes the spray head and the cleaning materials (e.g., paper towels) can be dispensed by pulling out a section of cleaning material and tearing it off.

The above specification, examples, and data provide a complete description of the manufacture and use of the composition of the invention. Since many embodiments of the invention can be made without departing from the spirit and scope of the invention, the invention resides in the claims hereinafter appended.

I claim:

1. A cleaning device comprising:

a housing including a cylindrical side wall, a partially capped end, and an open end, the open end being configured to receive a roll of cleaning material;

a fluid reservoir extending through a center portion of the housing, the fluid reservoir including a neck and an enlarged cylindrical section, wherein the enlarged cylindrical section includes a radial recess; and a spray head attached to the neck portion of the reservoir, wherein the open end of the housing is configured to be seated in the radial recess of the fluid reservoir and wherein the neck of the reservoir is configured to support the partially capped end of the housing at least in an axial direction, wherein the housing includes a side opening for dispensing the roll of cleaning material, the side opening includes an upper end portion, a lower end portion, and a mid portion, and wherein the mid portion includes an aperture therein that is configured to allow finger access to the inside of the housing.

2. The device of claim 1, wherein a portion of the neck extends through the housing and a portion of the neck extends out of the housing.

3. The device of claim 2, wherein the neck of the reservoir is threaded to the spray head.

4. The device of claim 2, wherein the neck has a diameter of less than about 3 inches.

5. The device of claim 2, wherein the neck has a length of between about 4 to 24 inches.

6. The device of claim 1, wherein the open end of the housing is located at a lower end of the housing and the enlarged cylindrical section provides a base for the cleaning device.

7. The device of claim 1, wherein the housing is generally cylindrical.

8. The device of claim 1, wherein the enlarged cylindrical portion is at an end of the neck.

9. The device of claim 1, wherein the diameter of the enlarged cylindrical portion is between about 3 to 12 inches.

10. The device of claim 1, wherein the side opening includes an overlapping portion of the cylindrical side wall.

11. A method of using a cleaning device comprising:

pouring cleaning fluid into a neck of a reservoir;

positioning a roll of cleaning material around the neck of the reservoir;

connecting a spray head to the neck of the reservoir;

enclosing the roll of cleaning material in a housing by connecting the reservoir to an open end of the housing, and reaching through an opening in the housing and pulling a portion of the cleaning material out of a side opening in the housing, wherein connecting the reservoir to the open end of the housing includes seating the open end of the housing in a radial recess of the reservoir and engaging the neck of the reservoir with a partially capped end of the housing such that partially capped end is supported by the neck at least in an axial direction.

12. The method of claim 11, further connecting the spray head to the neck after the roll of cleaning material is placed in the housing.

13. The method of claim 11, wherein the act of pulling the portion of the cleaning material through the side opening in the housing rotates the roll of cleaning material about at least a portion of the neck of the reservoir.

14. The method of claim 11, further comprising squeezing the spray head to spray cleaning fluid on a surface.

15. The method of claim 14, further comprising tearing a section of cleaning material from the roll of cleaning material.

16. The method of claim 11, wherein the step of connecting the spray head of the neck includes threading the neck to the reservoir to the spray head.

* * * * *

UNITED STATES PATENT AND TRADEMARK OFFICE

CERTIFICATE OF CORRECTION

PATENT NO. : 7,743,947 B2
APPLICATION NO. : 11/825134
DATED : June 29, 2010
INVENTOR(S) : Stephen John Flasch It is certified that error appears in the above-identified patent and that said Letters Patent is hereby corrected as shown below:

Col. 4, lines 54 and 55 “to the reservoir” should read -- of the reservoir --

Signed and Sealed this
Eighteenth Day of January, 2011

David J. Kappos

David J. Kappos
*Director of the United States Patent and Trademark Office*